US005432491A

United States Patent [19]

Peter et al.

[11] Patent Number: 5,432,491

[45] Date of Patent: Jul. 11, 1995

[54] BIMETAL CONTROLLED CIRCUIT BREAKER

[75] Inventors: Josef Peter, Altdorf; Peter Meckler, Sengenthal; Fritz Krasser, Altdorf; Gerhard Endner, Nürnberg, all of Germany

[73] Assignee: Ellenberger & Poensgen GmbH, Altdorf, Germany

[21] Appl. No.: 33,591

[22] Filed: Mar. 19, 1993

[30] Foreign Application Priority Data

Mar. 31, 1992 [DE] Germany ..... 9204342 U
Jun. 9, 1992 [DE] Germany ..... 9207762 U

[51] Int. Cl.[6] ..... H01M 75/12
[52] U.S. Cl. ..... 335/35; 335/23
[58] Field of Search ..... 335/35, 23, 24, 25, 335/36, 37, 43

[56] References Cited

U.S. PATENT DOCUMENTS

| | | | |
|---|---|---|---|
| Re. 32,882 | 3/1989 | Yokoyama et al. . | |
| 2,370,024 | 2/1945 | Dyer | 335/35 |
| 2,854,546 | 9/1958 | Cole | 335/35 |
| 3,211,955 | 10/1965 | Soos, Jr. . | |
| 3,521,127 | 7/1970 | Shand . | |
| 3,594,668 | 7/1971 | Clarke et al. . | |
| 3,601,562 | 8/1971 | Gryctko . | |
| 3,651,436 | 3/1972 | Cooper et al. . | |
| 3,706,100 | 12/1972 | Halbeck et al. . | |
| 3,706,916 | 12/1972 | Halbeck et al. . | |
| 3,863,186 | 1/1975 | Mallonen . | |
| 3,863,186 | 1/1975 | Mallonen . | |
| 4,317,094 | 2/1982 | Peterson . | |
| 4,386,329 | 5/1983 | Norden | 335/42 |
| 4,475,094 | 10/1984 | Grenier et al. . | |
| 4,502,033 | 2/1985 | Grenier . | |

FOREIGN PATENT DOCUMENTS

| | | |
|---|---|---|
| 0099233 | 1/1984 | European Pat. Off. . |
| 0391086 | 10/1990 | European Pat. Off. . |
| 657824 | 5/1929 | France . |
| 645755 | 5/1937 | Germany . |
| 518833 | 10/1965 | Germany . |
| 245200 | 10/1946 | Switzerland . |

*Primary Examiner*—Lincoln Donovan
*Attorney, Agent, or Firm*—Spencer, Frank & Schneider

[57] ABSTRACT

A bimetal controlled circuit breaker includes a current bus that is electrically connected in series with the bimetal element. The current bus extends parallel to the bimetal element in the deflection plane of the latter and is rigid relative to the bimetal element. The deflection of the bimetal element is supported by the action of electrodynamic forces. In order for the circuit breaker to be suitable for greater current intensities and the effect of the electrodynamic forces to be better utilized, the bimetal element is electrically connected in parallel with a shunt path.

12 Claims, 3 Drawing Sheets

BIMETAL CONTROLLED CIRCUIT BREAKER

BACKGROUND OF THE INVENTION

The invention relates to a circuit breaker having a bimetal element, and a current bus extending parallel to and within a deflection plane of the bimetal element. The current bus is rigid relative to the bimetal element for supporting a deflection of the bimetal element caused by an action of electrodynamic forces.

Such circuit breakers are disclosed, for example, in EP 0,391,086.A1. There, a U-shaped bimetal element is connected electrically in series with a likewise U-shaped extension which acts as a current bus. The current bus here flanks the bimetal element in such a way that the current directions of the sections of current bus and bimetal element that face one another in the deflection plane of the bimetal element are opposite. Due to these oppositely directed currents, bimetal element and current bus will greatly repel one another, particularly at high currents. Since the current bus is fixed in the circuit breaker housing, the repelling forces act fully on the bimetal element as additional electrodynamic forces in order to bend it outwardly in its deflection plane. The relatively slow, thermally caused deflection movement of the bimetal element is consequently supported by the effect of the electrodynamic forces. Since this effect occurs particularly at very high currents, the turn-off time in the case of a short circuit is thus particularly short. With small currents, the electrodynamic force effect is of only subordinate significance or is not effective at all.

In the prior art bimetal controlled circuit breaker, the bimetal element may be overloaded by currents that are too high. It is destroyed or at least adversely affected in its accuracy and sensitivity of response. Thus reliable operation of the circuit breaker is no longer ensured. To overcome this danger, prior art circuit breakers can be employed only within a very limited spectrum of different current intensities. Under certain circumstances, several circuit breakers must be employed for different current intensities.

In order not to be overloaded at high current intensities, the bimetal element may be made more robust, for example by enlarging its cross section. However, a more robust construction adversely influences its sensitivity and accuracy of response.

SUMMARY OF THE INVENTION

Based on these drawbacks, it is the object of the invention to construct a bimetal controlled circuit breaker in such a way that it is suitable for greater current intensities. Moreover, the response sensitivity and accuracy of the bimetal element is to be improved. This is accomplished by connecting the bimetal element in parallel with a shunt path to divide a current in the circuit.

Due to the shunt path being connected electrically in parallel with the bimetal element, the circuit breaker is suitable for a large spectrum of different current intensities without the bimetal element having to be changed. The necessary maximum permissible current intensities are considered in a simple manner by an appropriate line resistance in the shunt path. This is done in a known manner by different length or cross-sectional dimensions or also by the selection of a different material for the shunt path. Depending on the structural requirements for the circuit breaker and the existing manufacturing devices for the shunt path, it is more advantageous to vary the length, the cross section or the specific resistance of the shunt path.

One and the same circuit breaker is therefore suitable for all current ranges simply by exchanging its shunt path. The circuit breakers usable for different current spectra are technically and structurally identical except for the shunt path. This reduces manufacturing and logistics expenses for the circuit breakers.

It may be more favorable from a manufacturing technology point of view to adapt the circuit breaker to different current intensities solely by selecting a different bimetal element. This additionally has the advantage that the highest permissible current intensity for the circuit breaker and its response characteristic based on heating of the bimetal element can be varied simultaneously in a simple manner. Preferably, the bimetal elements differ only by their material, while their geometrical dimensions remain essentially unchanged. This facilitates manufacture of the various bimetal elements. Also, no additional structural requirements arise for the housings of such different circuit breakers, which further simplifies manufacture of the circuit breakers.

It is also conceivable to adapt the circuit breaker to different current intensities by exchanging the bimetal element and the shunt path and/or the current bus.

The parallel connected shunt path has the additional effect that the cross section of the bimetal element can be reduced without overloading its material with excess current. A bimetal element having a smaller cross section exhibits better spring characteristics for its deflection. The spring characteristics of the bimetal element are characterized by its resistance moment which is a function of the width and the thickness of the bimetal element. The width is here a linear function and the thickness is squared in the formation of the resistance moment. Such improved spring characteristics in the bimetal element have the result that the effect of the electrodynamic forces of the current bus on the bimetal element is improved. The thermally caused deflection movement of the bimetal element is also facilitated. Consequently, the response sensitivity of the bimetal element is increased and shorter response times are realized. The required or desired response characteristics can therefore be considered in a simple manner by way of bimetal elements that have different cross sections. Typically, the shunt path is configured as a shunt bus and, when appropriately connected in parallel with the bimetal element, also produces an electrodynamic force between the shunt bus and the bimetal element, with the rigid shunt bus, which is fixed to the circuit breaker housing, causing the electrodynamic force to act fully on the bimetal element. Thus the response sensitivity of the circuit breaker is further increased without additional components. In the placement of the shunt bus it is merely necessary to consider the desired or required repulsion or attraction of the bimetal element.

The parallelism of bimetal element, shunt bus and current bus additionally enhances the space saving configuration of the circuit breaker.

The arrangement of current bus, bimetal element and shunt bus is such that the shunt bus is positioned on a side of the bimetal element opposite to the current bus. With the appropriate current direction in the individual sections of current bus, bimetal element and shunt bus, it is possible, for example, to have a repelling force active between bimetal element and current bus so that the bimetal element is deflected in the direction toward the shunt bus. This deflection movement is supported by an attraction force exerted on the bimetal element by the shunt bus. For this purpose, the shunt bus must be configured for a current flow direction which produces the attraction force. The augmented electrodynamic force effect has the advantage that it becomes effective already for smaller excess currents and thus further increases the response sensitivity of the circuit breaker.

The current bus and shunt bus disposed on opposite sides of the bimetal element further enhance the space saving configuration of the circuit breaker. In contrast to an arrangement of both buss on one side of the bimetal element, the forces of the two buses are unable to influence one another. They each act on the bimetal element independently and with their maximum possible force.

Preferably, the current bus and shunt bus have a profile and length that corresponds to the bimatal element. This improves the effect of the electrodynamic forces on the bimetal element.

The bimetal element is given the shape of a U. The U-plane is disposed at a right angle to the deflection plane and the free ends of the U-legs forming the contact ends are fixed in location. The contact ends, on the one hand, cause the bimetal element to be electrically connected in series with the circuit in a simple manner. On the other hand, the unilateral fixing of the bimetal element in the region of its contact ends causes the connecting yoke that connects the two legs of the U to provide a mechanically stable deflection end for the bimetal element. With such a deflection end, a very effective force transfer is created from the deflected bimetal element to, for example, a switch lock to reliably interrupt the current within the circuit breaker.

By means of the U legs of the bimetal element and the current bus and/or shunt bus, which also have a U shape, the desired current flow in the opposite or identical direction are produced in a structurally simple manner within the bimetal element and the two buss so as to generate the electrodynamic forces required for an improved response characteristic.

Typically, the bimetal element, current bus and shunt bus are connected with one another at their contact ends or shunt contacts, respectively. In the case of the U-shaped configuration of the bimetal element and the two buses, preferably the free ends of the U-legs are employed as contact ends or shunt contacts, respectively. Due to the parallel spacing of bimetal element, current bus and shunt bus required to obtain the electrodynamic forces, a structurally simple technique is possible for connecting these components in the region of the free ends of the U-legs.

On the one hand, the connections act as electrical contacts between the bimetal element, current bus and shunt bus and, on the other hand, as stationary mechanical means for fixing the components to one another. Since the current bus and shunt bus are fixed in the housing, the structural unit composed of the bimetal element, current bus and shunt bus is sufficiently fastened when the circuit breaker is installed and is thus well protected against the influence of extraneous forces. The bimetal element, current bus and shunt bus as a structural unit also need not be fastened separately within the circuit breaker housing so that additional fastening means are not required. This has a component and cost saving effect. Moreover, installation costs are kept low.

Due to the parallel spacing between bimetal element, current bus and shunt bus, which is necessary for effective electrodynamic forces, this compact modular unit has a small size. The circuit breaker housing can thus be given smaller dimensions.

Preferably, the connection between bimetal element, current bus and shunt bus is welded. Transfer resistances between bimetal element, current bus and shunt bus are thus reduced. The weld connections additionally give a long service life to bimetal element, current bus and shunt bus as a compact structural unit.

Typically, the structural unit is additionally fixed to a carrier console. This enhances the mechanical stability of the structural unit when installed. Since the carrier console constitutes part of the circuit, it, in addition to the current bus, is the second connecting contact for the structural unit in order to connect it electrically in series with the circuit. Mechanically stable and electrically contacting connections between the components are realized by one and the same measure. This has a component and cost saving effect. The use of only a few components also makes it possible to give the circuit breaker housing smaller dimensions.

Preferably, the carrier console is fastened to a housing wall. This type of fastening makes it possible for the carrier console to be contacted directly, without the intermediary of additional current conducting components, with a current conductor connected to the circuit breaker. This is again component, cost and space saving. Moreover, additional transfer resistances are avoided.

Typically, the electrical contacts between the carrier console and an external current lead or an electrical load comprises a connecting pin.

The connecting pin performs the dual function of, on the one hand, a mechanical fixing and fastening means and, on the other hand, an electrical contacting means for the carrier console.

A carrier console preferably includes an adjustment screw. This also enhances the space saving configuration of the circuit breaker.

The adjustment screw employed provides for an always changeable setting of the response sensitivity. Thus, one and the same circuit breaker can be tripped at different rated currents.

BRIEF DESCRIPTION OF THE DRAWINGS

The subject matter of the invention will now be described in greater detail with reference to embodiments thereof that are illustrated in the drawings, in which.

DESCRIPTION OF THE PREFERRED EMBODIMENT

Figure 1:
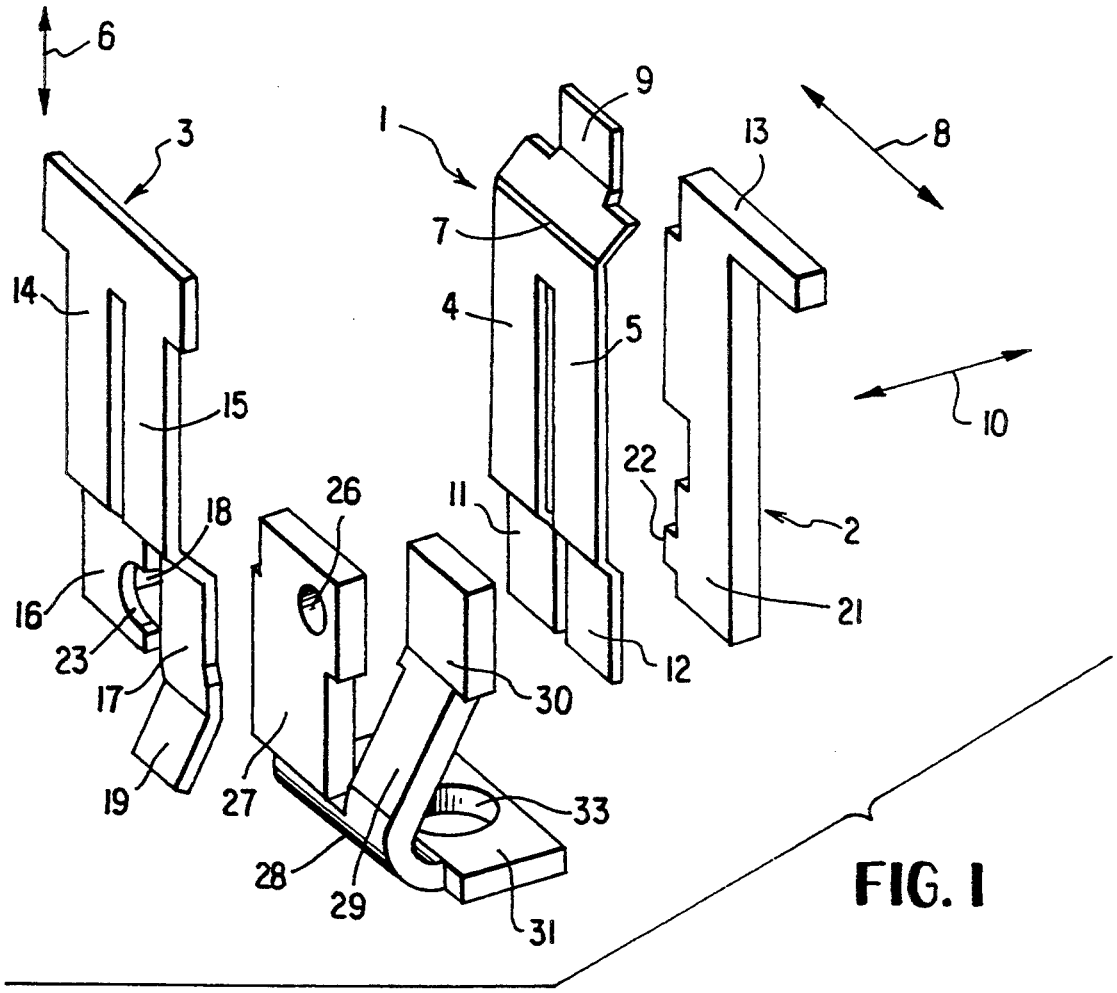
FIG. 1 is an exploded view of an excess current monitoring device.

The structure of the individual components of the excess current monitoring device will be described with reference to FIG. 1.

What is involved is a bimetal structural unit including a U-shaped bimetal element 1, a strip-shaped current bus 2 and a U-shaped shunt bus 3. Bimetal element 1, current bus 2 and shunt bus 3 are arranged in mutually parallel planes.

The two U-legs 4 and 5 of bimetal element 1 are arranged in a longitudinal direction 6. The base of the U constitutes the deflection end 7 of bimetal element 1 and extends in a depth direction 8 that lies at a right angle to longitudinal direction 6. In its region remote from bimetal legs 4 and 5, deflection end 7 is bent about 45° in the direction of current bus 2. The region of deflection end 7 that is bent about 45° is followed by a bimetal projection 9. Seen in a transverse direction 10 extending perpendicular to longitudinal direction 6 and perpendicular to depth direction 8, bimetal projection 9 has a rectangular shape. It is disposed in a plane that is parallel to bimetal legs 4 and 5. Bimetal projection 9 is less wide in depth direction 8 than deflection end 7 and is shaped to the middle of the end of the bent-away region of deflection end 7. The free ends of bimetal legs 4 and 5, are approximately square in transverse direction 10 and form bimetal contact ends 11 and 12. They are offset in the direction of current bus 2 relative to the remaining region of bimetal legs 4 and 5. In the final installed position, current bus 2 covers bimetal leg 4 when seen in transverse direction 10.

The deflection plane of bimetal element 1 is defined by longitudinal direction 6 and transverse direction 10.

A bus extension 13 is shaped in one piece to the end of current bus 2 facing deflection end 7. Seen in depth direction 8, bus extension 13 has an approximately square cross section. The longitudinal extent of bus extension 13 corresponds to depth direction 8. Current bus 2 and bus extension 13 are arranged perpendicular to one another. Together they have the shape of an L.

Current bus 2 and bus extension 13 are made of one piece of a metal strip. However, this metal strip is only half as wide in depth direction 8 in the region of current bus 2 as in the region of bus extension 13. When seen in transverse direction 10, the outer region of current bus 2 facing bimetal leg 4 in depth direction 8 is provided with a plurality of rectangular indentations or grooves. The width of bimetal element 1 in depth direction 8 is somewhat less than the corresponding expanse of bus extension 13.

Shunt bus 3 has the same U shape as bimetal element 1. It is disposed in a plane that is parallel to bimetal element 1. The base of the U of shunt bus 3 projects over the two shunt legs 14 and 15 in depth direction 8. Its expanse in this direction is somewhat greater than the corresponding expanse of bus extension 13. The two shunt legs 14 and 15 and the leg ends 16 and 17 following thereafter correspond in outline and arrangement approximately to bimetal legs 4 and 5 and to their bimetal contact ends 11 and 12.

Leg ends 16 and 17, however, are extended by fastening ends 18 and 19. Leg end 17 is extended by means of fastening end 19 approximately in longitudinal direction 6. Fastening end 19, however, is bent away from bimetal element 1. Seen in transverse direction 10, fastening end 19 is approximately square.

Compared to the associated shunt leg 14, leg end 16 has a larger expanse in depth direction 8. It is followed by fastening end 18 which is bent at a right angle and oriented toward current bus 2. Seen in depth direction 8, the outline of fastening end 18 is essentially rectangular (FIG. 2). In its central region, fastening end 18 is penetrated in depth direction 8 by a rectangular contact opening 20. The surface of current bus 2 facing fastening end 18, as already mentioned in connection with FIG. 1, includes a plurality of grooves and indentations. At the bus end 21 of current bus 2 facing away from bus extension 13, there is shaped a contact indentation 22 which extends in depth direction 8. Its outline is adapted to the outline of contact opening 20 in such a way that, in the final installed state, a form-locking connection is established between current bus 2 and fastening end 18.

In its region facing leg end 17, leg end 16 is penetrated in transverse direction 10 by a screw opening 23. The outline of leg end 16 approximately corresponds to that of a semi-circle with the concave side facing leg end 17. In the final installed state, screw opening 23 allows an adjustment screw 24 (FIG. 3) and its insulating pin 25 to pass through leg end 16 without contacting it and to act on the bimetal contact end 11 of bimetal element 1. The cylindrical insulating pin 25 is shaped centrally to the end face of adjustment screw 24 where it faces bimetal element 1. The effective direction of adjustment screw 24 corresponds to transverse direction 10. Adjustment screw 24 is mounted in a threaded bore 26. Threaded bore 26 penetrates the current-less bearing arm 27 of a carrier console 28 in transverse direction 10. In this direction, bearing arm 27 has the outline of a rectangular plate. In the region of its corner edge facing shunt leg 14 and in the region of the diagonally oppositely disposed corner edge (FIG. 3), bearing arm 27 is given a rectangular recess.

In depth direction 8, a connecting arm 29 is shaped in one piece to carrier console 28 in addition to bearing arm 27. Seen in transverse direction 10, the outline of connecting arm 29 is essentially rectangular. While in the final installed position the current-less bearing arm 27 is disposed parallel to the leg end 16 of shunt bus 3, connecting arm 29 is bent away in the direction of current bus 2. Connecting arm 29 and fastening end 19, which is likewise bent away from leg end 17, are disposed in mutually parallel planes. A bimetal contact surface 30 that extends parallel to current bus 2 is shaped in one piece to the free end of connecting arm 29.

Seen in transverse direction 10, bimetal contact surface 30 has a square outline. In depth direction 8, on the side facing away from bearing arm 27, the plate-like bimetal contact surface 30 projects beyond connecting arm 29.

Seen in longitudinal direction 6, a bottom member 31 as part of carrier console 28 is rectangular. In the final installed position, a connecting pin 32 (FIG. 4) is electrically contacted at bottom member 31. In order to connect carrier console 28 and connecting pin 32 in a form-locking and electrically contacting manner, bottom member 31 is penetrated in longitudinal direction 6 by a cylindrical pin opening 33.

Figure 3:
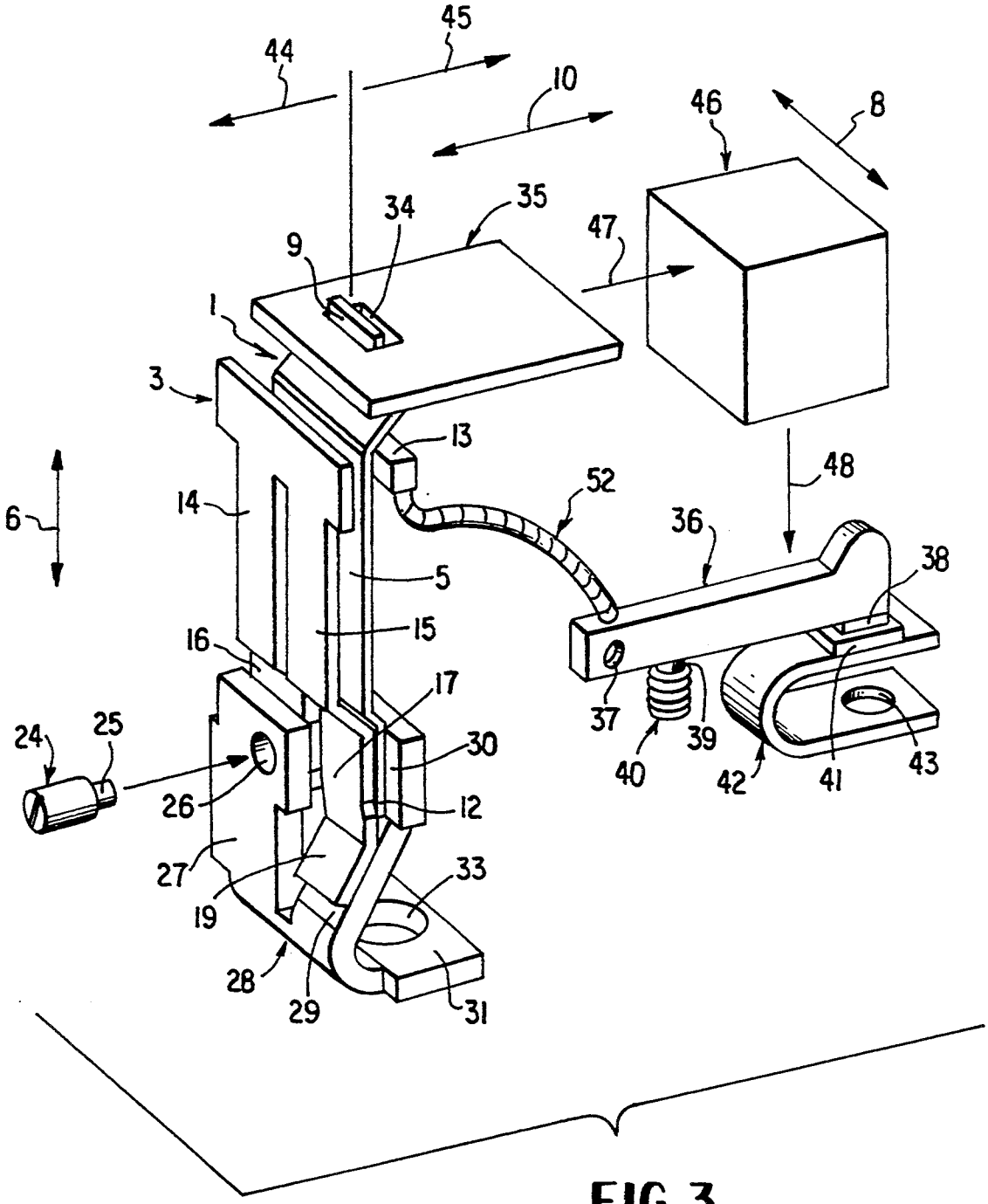
FIG. 3 is a perspective view of the circuit within a circuit breaker.

In FIG. 3, the bimetal unit is shown in its assembled state.

Bus end 21 is welded to the bimetal contact end 11 of bimetal element 1. The contact indentation 22 in current bus 2 is connected and electrically contacted by way of a form lock with the fastening end 18 of shunt bus 3. The bimetal contact end 12 of bimetal element 1 is welded to bimetal contact surface 30. The same applies for the fastening end 19 of shunt bus 3 and connecting arm 29.

The facing end faces of bimetal contact end 11 and leg end 16 are separated from one another by an air gap. For additional insulation, an insulating disc may be placed between these two end faces.

Bimetal projection 9 passes through a rectangular slide slot 34 in a slide 35. Slide 35 is mounted in the housing and extends in the plane defined by depth direction 8 and transverse direction 10. Seen in longitudinal direction 6, slide 35 has a rectangular outline. In transverse direction 10, slide slot 34 is broader than bimetal projection 9. Depending on the ambient temperature and the adjustment of bimetal element 1, bimetal projection 9 lies in a different position within slide slot 34 along transverse direction 10.

To avoid short circuits, slide 35 is produced of an electrically non-conductive material.

Bus extension 13 and a contact lever 36 are connected with one another by means of an electrically conductive stranded wire 52. Contact lever 36 is composed of electrically conductive material.

Contact lever 36 extends essentially in transverse direction 10. In its end region facing bimetal element 1, contact lever 36 is provided with a bearing opening 37. It penetrates contact lever 36 in depth direction 8.

Bearing opening 37 is penetrated by a non-illustrated shaft that extends in depth direction 8 and is fixed to the housing. Thus contact lever 36 is mounted so as to be fixed to the housing. On the surface of contact lever 36 facing away from slide 35 in longitudinal direction 6, a plate-shaped contact member 38 is fastened. Contact member 38 is disposed in the end region of contact lever 36 facing away from bearing opening 37 in transverse direction 10.

A pin 39 extending in longitudinal direction 6 is shaped to the surface of contact lever 36 connected with contact member 38. When viewed in transverse direction 10, pin 39 is disposed between bearing opening 37 and contact member 38 but at a shorter distance from bearing opening 37. Pin 39 is form-lockingly surrounded by a compression spring 40. Compression spring 40 acts against a surface (not shown here) and is charged with pressure in longitudinal direction 6 by contact lever 36. Compression spring 40 supports the retention of contact lever 36 in a defined turn-on position (FIG. 3) and in a defined turn-off position.

Contact member 38 cooperates with a fixed contact 41 for closing and opening the circuit. Fixed contact 41 is likewise plate-shaped. Fixed contact 41 is fastened to a carrier base 42. Seen in depth direction 8, carrier base 42 is a metal strip that has been bent in the shape of a U. The U-legs extend in transverse direction 10. The base of the U faces bimetal element 1. Fixed contact 41 is disposed in the end region of the U-leg of carrier base 42 facing contact lever 36.

The end faces of contact member 38 and fixed contact 41, which face one another in longitudinal direction 6, constitute their contact faces. These contact faces extend approximately in the plane defined by depth direction 8 and transverse direction 10. If the facing end faces of contact member 38 and fixed contact 41 contact one another (FIG. 3), carrier base 42 is electrically connected with bus extension 13.

The U-leg of carrier base 42 facing away from contact lever 36 is penetrated in longitudinal direction 6 by a pin opening 43. It serves the same purpose as pin opening 33 in the region of bottom member 31.

By means of adjustment screw 24, the bimetal contact end 11 of bimetal element 1 is charged with pressure. Bimetal legs 4 and 5 can be biased against one another by adjustment of adjustment screw 24. Thus bimetal element 1 is adjusted and it is possible to set a different response sensitivity.

In order for the utilization of the electrodynamic forces to move only bimetal element 1, current bus 2 is fixed in place within the circuit breaker housing in the region of its bus extension 13 and shunt bus 3 in the region of its U-base. This fixing produces the required immobility of current bus 2 and shunt bus 3 relative to bimetal element 1. At the same time, current bus 2 is still sufficiently movable in the region of its bus end 21 and shunt bus 3 in the region of its leg end 16 for the pressure charge on bimetal contact end 11 by means of adjustment screw 24 not to be interfered with. To make bus end 21 movable to a certain degree relative to the remaining region of current bus 2, the latter is given weaker dimensions in the region of its bus end 21 and its contact indentation 22 due to the stepped arrangement of recesses in depth direction 8.

Figure 2:
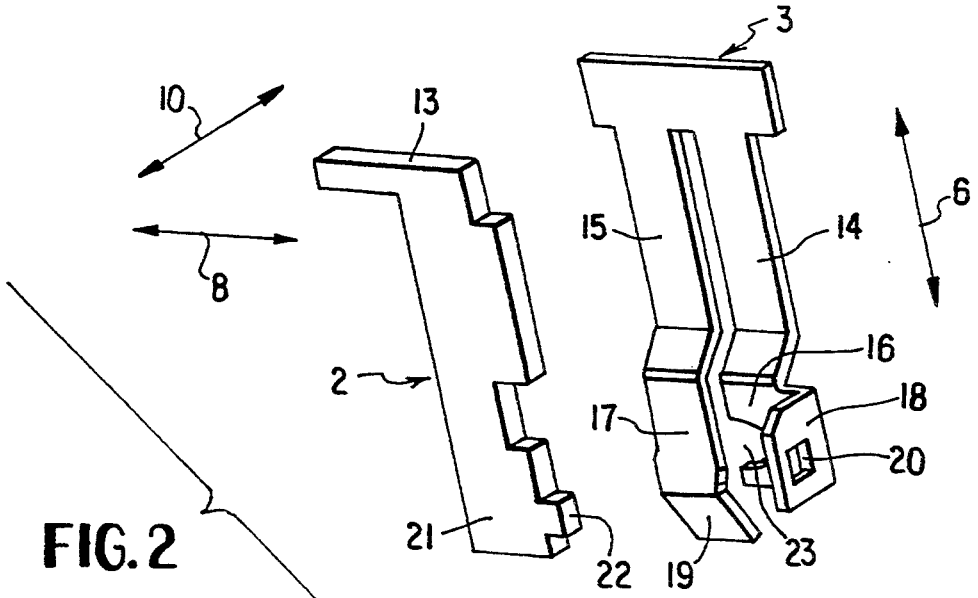
FIG. 2 is a rear view of parts of the excess current monitoring device of FIG. 1.

A current starting from carrier base 42 and flowing in the direction of current bus 2 is divided in the region of bus end 21 (FIG. 1). One part flows through bimetal element 1 from bimetal contact end 11 to bimetal contact end 12. The other part of the current flows through shunt bus 3 from fastening end 18 to fastening end 19. In the region of the connecting arm 29 of carrier console 28, the two partial currents are added together again. Bimetal element 1 is configured in such a way that thermal conditions cause the deflection end 7 to be deflected in its deflection plane in the direction toward a deflection side 44 whenever there is a slight excess current. The side facing away from this deflection side is the rear side 45.

While the deflection movement of bimetal element 1 as a result of thermal conditions is effective primarily at low excess currents, bimetal element 1 is deflected primarily by electrodynamic forces if the excess currents are very high. At high excess currents, the electrodynamic force supports or replaces, respectively, the relatively slow thermally caused deflection movement of bimetal element 1 so that, in the case of a short circuit, the turn-off time is shorter and the response characteristic of the circuit breaker is improved.

Current bus 2 and bimetal leg 4 act as two parallel conductors through which the current flows in opposite directions. Such conductors repel one another due to the effect of electrodynamic forces. Shunt leg 14 and bimetal leg 4 as well as shunt leg 15 and bimetal leg 5, respectively, act as two parallel conductors through which the current flows in the same direction. Due to the electrodynamic force effects, such conductors attract one another. Since current bus 2 and shunt bus 3 are fixed in place, only the deflection end 7 of bimetal element 1 is moved in the direction of deflection side 44.

To close and open the circuit within the circuit breaker, slide 35 and contact lever 36 cooperate with a switch lock 46 (FIG. 3). Switch lock 46 is shown schematically as an approximately square box. It may be composed of various electrical and mechanical components, e.g. of switches and levers. The directions of the arrows 47 and 48 indicate the cooperation of slide 35 and contact lever 36 with switch lock 46.

Slide 35, for example, acts on a non-illustrated release element of switch lock 46. During the deflection movement of bimetal element 1, bimetal projection 9 abuts at slide slot 34. This causes slide 35, which is supported within the housing, to be moved in the direction of deflection side 44 (FIG. 3). The switch position of the non-illustrated actuator causes the pressure charging effect of switch lock 46 on contact lever 36 in the direction of fixed contact 41 to be terminated. Contact lever 36 is rotated counterclockwise around an axis that passes through bearing opening 37. The counterclockwise rotation of contact lever 36 is supported by compression spring 40. Contact lever 36 thus reaches its defined turn-off position.

In order to move contact lever 36 into its turn-on position (FIG. 3), a non-illustrated actuating element may be provided at switch lock 46. The actuating element can be switched by an operator. Thus, switch lock 46 generates its pressure charging effect on contact lever 36. This causes contact lever 36 to be rotated clockwise around the axis passing through bearing opening 37 in the direction toward fixed contact 41. In the turned-on position of contact lever 36, the facing end faces of contact member 38 and fixed contact 41 are in contact with one another. The circuit within the circuit breaker is thus closed. The effective direction of the contact pressure corresponds to longitudinal direction 6. The contact pressure is additionally improved by the action of compression spring 40.

The pressure charging effect of switch lock 46 on contact lever 36 to keep it in its turn-on position (FIG. 3) may be terminated by an operator, for example by way of the non-illustrated actuating element. Or, switch lock 46 may be connected with an electronic unit for remotely controlling the switch position of contact lever 36.

The bimetal component shown in FIGS. 1 to 4 is also suitable for current intensities above 50 A. Due to the parallel connected shunt bus 3, the current is divided which permits a reduction in the cross section of bimetal element 1. The reduction in cross section produces improved spring characteristics for bimetal element 1 so that the electrodynamic force effect can be utilized better.

Figure 4:
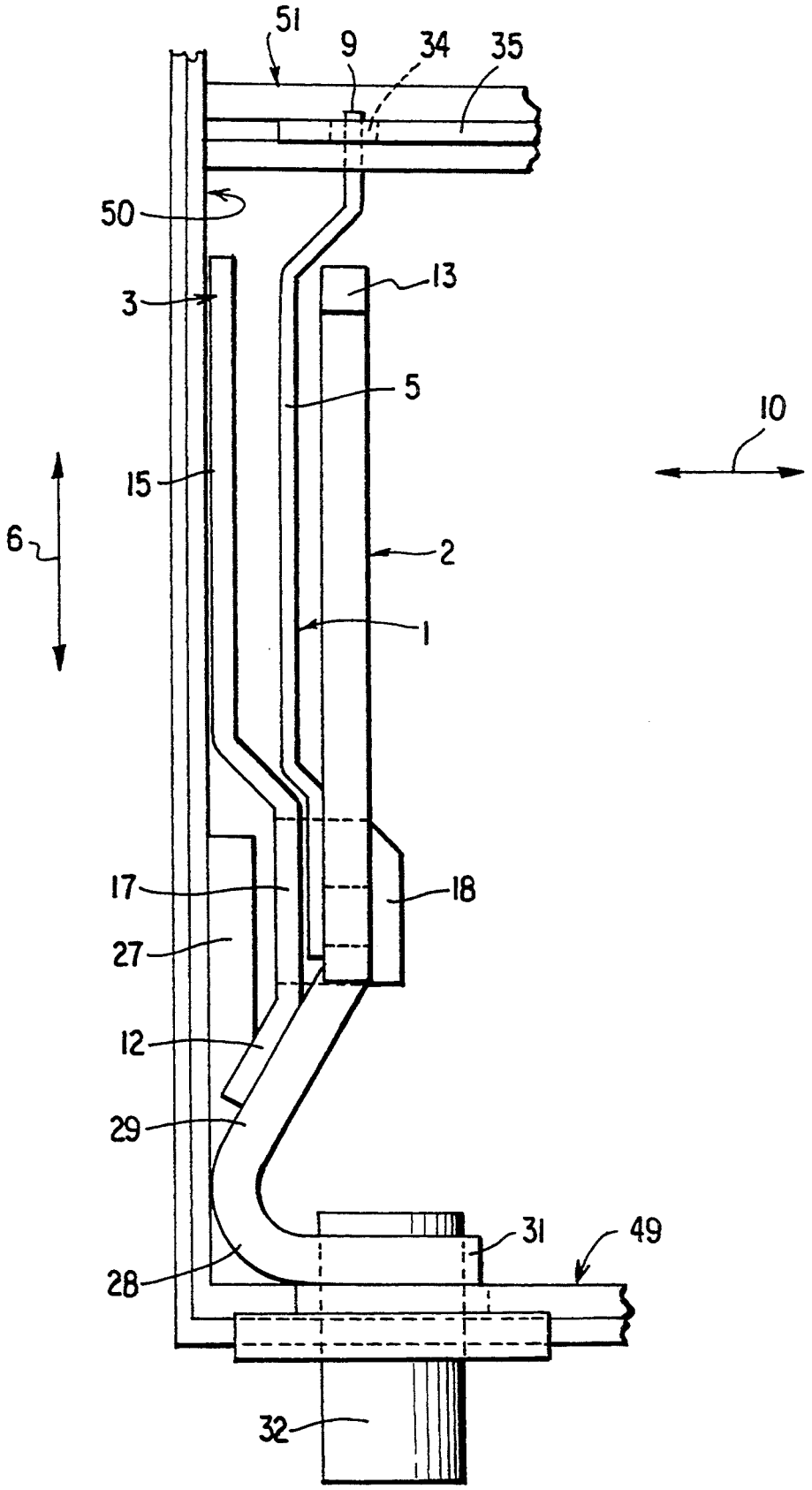
FIG. 4 is a side view of the excess current monitoring device in the final installed state with a partial illustration of the circuit breaker housing.

FIG. 4 shows the bimetal component fastened to a housing wall 49 of the circuit breaker. Connecting pin 32 passes in a form lock through housing wall 49 and bottom member 31 and in this way produces a firm, mechanical connection between housing wall 49 and carrier console 28.

Due to its configuration, the bimetal component is a self-supporting, compact and stable unit and requires no additional fastening means, except for carrier console 28, to fix current bus 2 and shunt bus 3 to the circuit breaker housing. Due to the required insulation, the entire circuit breaker housing, that is, also housing wall 49 and a housing wall 50 arranged perpendicular thereto, are made of an insulating material. An external current lead or an electrical load can be connected to connecting pin 32.

FIG. 4 indicates that the geometric configuration of the bimetal component is well adapted to the course of housing walls 49 and 50. This space-saving configuration makes it possible for the circuit breaker housing to have small dimensions. In the region of bimetal projection 9, a slide housing 51 is shaped to housing wall 50. Slide housing 51 extends in transverse direction 10. Slide 35 is mounted in slide housing 51. The movements of slide 30 are conducted in transverse direction 10. The movements of all components are performed in the deflection plane defined by longitudinal direction 6 and transverse direction 10. This also enhances the space saving configuration of the circuit breaker housing.

We claim:

1. A bimetal controlled circuit breaker connected in series within a circuit, comprising:

a bimetal element; and a current bus extending parallel to and within a deflection plane of said bimetal element, said current bus being rigid relative to said bimetal element for supporting a deflection of said bimetal element caused by an action of electrodynamic forces; and a circuit element constituting a shunt path connectable in parallel with said bimetal element to divide a current in the circuit.

2. A bimetal controlled circuit breaker as defined in claim 1, wherein the circuit element comprises a shunt bus, is rigid relative to said bimetal element and extends parallel to and within the deflection plane of said bimetal element.

3. A bimetal controlled circuit breaker as defined in claim 2, wherein said shunt bus is positioned on a side of said bimetal element opposite to said current bus.

4. A bimetal controlled circuit breaker as defined in claim 2, wherein one of said current bus and said shunt bus has a profile that approximately corresponds to a profile of said bimetal element.

5. A bimetal controlled circuit breaker as defined in claim 2, wherein one of said current bus and said shunt bus has an effective length that approximately corresponds to a length of said bimetal element.

6. A bimetal controlled circuit breaker as defined in claim 2, wherein said bimetal element has a U-shape being defined by a deflective yoke and two legs, each said leg having a positionally fixed contact end and a deflection end, said deflection ends being connected together by the deflecting yoke, said U-shape which is in a plane being approximately at a right angle to the deflection plane, and wherein one of said current bus and said shunt bus has a U-shape having a connecting yoke positionally corresponding to the deflecting yoke.

7. A bimetal controlled circuit breaker as defined in claim 6, wherein said current bus and said shunt bus each include a leg having a respective contact end, said bimetal element contact ends being connected to said contact ends of said current bus and said shunt bus, and wherein said current bus includes a first shunt contact comprising a contact indentation and said shunt bus includes a second shunt contact comprising a fastening end of said shunt bus are connected together with the contact indentation.

8. A bimetal controlled circuit breaker as defined in claim 7, wherein the connections comprise welded connections.

9. A bimetal controlled circuit breaker as defined in claim 7, further comprising a carrier console within the circuit, wherein said bimetal element, current bus and shunt bus collectively form a unit fixed in contact with said carrier console by one of the fastening ends of said shunt bus and either of the fixed contact ends of said bimetal element.

10. A bimetal controlled circuit breaker as defined in claim 9, further comprising a housing wall, wherein said carrier console is fastened to said housing wall.

11. A bimetal controlled circuit breaker as defined in claim 10, further comprising a connecting pin for the fastening of said carrier console to said housing wall, said connecting pin being electrically connected to an external electrical source.

12. A bimetal controlled circuit breaker as defined in claim 9, further comprising an adjustment screw means for acting on said bimetal element to adjust a response sensitivity of the circuit breaker; said carrier console including a connecting arm being connected to one of the fastening end of said shunt bus and, said either fixed contact end of said bimetal element, and a currentless bearing arm for supporting said adjustment screw.

* * * * *